US007770885B2

(12) United States Patent
Klein

(10) Patent No.: US 7,770,885 B2
(45) Date of Patent: Aug. 10, 2010

(54) VARIABLE STIFFNESS FRICTION BUCKLER

(75) Inventor: William Scott Klein, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 560 days.

(21) Appl. No.: 11/681,230

(22) Filed: Mar. 2, 2007

(65) Prior Publication Data

US 2008/0211169 A1 Sep. 4, 2008

(51) Int. Cl.
*B65H 3/52* (2006.01)

(52) U.S. Cl. ..... 271/121; 271/124; 271/167

(58) Field of Classification Search ..... 271/121, 271/21

See application file for complete search history.

(56) References Cited

U.S. PATENT DOCUMENTS

| | | | | |
|---|---|---|---|---|
| 5,895,040 | A * | 4/1999 | Oleksa et al. | 271/124 |
| 5,971,390 | A * | 10/1999 | Caspar et al. | 271/121 |
| 6,536,757 | B2 * | 3/2003 | Chang | 271/16 |
| 7,066,461 | B2 * | 6/2006 | Asada | 271/121 |
| 7,108,257 | B2 * | 9/2006 | Shiohara et al. | 271/104 |
| 7,434,800 | B2 * | 10/2008 | Asada et al. | 271/121 |

* cited by examiner

*Primary Examiner*—Patrick Mackey
*Assistant Examiner*—Luis Gonzalez
(74) *Attorney, Agent, or Firm*—James E. Cole; John Victor Pezdek

(57) ABSTRACT

A media buckler comprises a media engagement surface, a support structure having at least one dimension drafted from a first thickness to a second thickness, the engagement surface having varying stiffness.

17 Claims, 15 Drawing Sheets

SECTION A-A

SECTION B-B

SECTION C-C

VARIABLE STIFFNESS FRICTION BUCKLER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to media feed mechanisms. More particularly, the present invention relates to a variable stiffness friction buckler for the media feed mechanism to prevent multi-sheet feeding of recording media wherein two or more sheets are fed during a single sheet feeding operation.

2. Description of the Related Art

In a conventional single sheet printer, sheets from a media stack are indexed from the stack into the printer feedpath so as to begin a printing cycle. This operation is commonly known as sheet picking and is performed by advancing the uppermost sheet from the media stack using a motor driven roller in an arrangement sometimes referred to as a media feed mechanism which may include a rotational indexing or auto-compensating mechanism. The roller of the auto-compensating mechanism rotates against the surface of the uppermost media sheet to direct that sheet into the media feedpath for printing or other processing involving auto-document feeding.

Multiple sheet misfeeds are a common problem associated with sheet media feeding systems. As the uppermost sheet is picked from the stack of sheet media in the input tray, the next-to-top sheet or sheets are sometimes drawn into the feed mechanism by frictional forces between the top fed sheet and those beneath it. If these lower sheets are not cleared from the feed zone, then multiple sheets are likely to be drawn into the feed zone during the next print cycle resulting in a misfeed. This problem is prevalent where the media stack is stiff and is characterized by higher frictional forces between the media sheets. The problem is also prevalent when the stack is low, rendering the media stack stiffer than a thicker media stack. Accordingly, various separating means have previously been suggested for separating a top sheet of a stack of sheets of media from the next adjacent sheet.

Another consideration is the media weight. Additionally, a roller surface having a coefficient of friction high enough to separate a relatively heavy media such as cardstock, envelopes, and labels, for example, without causing the feed motor to overload will result in more multiple sheet feeding of a relatively light weight media with high friction between sheets such as bond or xerographic paper, for example. A printer needs to be capable of printing both heavy and light media to have a sufficient market.

In order to avoid such multiple sheet misfeeds, some printers have been fitted with a separator which uses friction to buckle the uppermost media sheet and inhibit multi-sheet feeding. However, the problem has still existed that as a media feed stack decreases in height during feeding, the stiffness of the media stack increases rendering feeding more difficult, and multi-sheet feeds and motor stalls more likely.

What is needed is a mechanism, which separates media in a media stack during feeding, inhibits multi-sheet feeds, and which compensates for change of stiffness in a media stack during the media feed process.

SUMMARY OF THE INVENTION

The variable stiffness friction buckler separates media sheets being fed into a media feedpath to prevent multi-sheet misfeeds during a media feeding process. A media buckler comprises a first surface defining a first dimension from a first end to a second end, a first s-shaped sidewall depending from the first surface, a second s-shaped sidewall depending from the first surface, a rib extending from the first surface, the media buckler having variable stiffness along the first dimension. At least one of the first surface, the first s-shaped sidewall and the second s-shaped sidewall is drafted from a first thickness to a second thickness. Further, each of said first surface, said first s-shaped sidewall and said second s-shaped sidewall is drafted from a first thickness to a second thickness. Alternatively, only portions of the s-shaped sidewalls are drafted. As a further alternative, at least portions of the first s-shaped sidewall and the second s-shaped sidewall are continuously tapered from the first end to the second end. The media buckler further comprises a media buckler assembly. The media buckler assembly further comprises a body having an aperture, the rib extending through the aperture. The rib stiffness varies across the aperture.

A media buckler assembly comprises a media dam, a housing connected to the media dam, the housing having an aperture, a friction buckler disposed between the housing and the media dam, the friction buckler having a first end and a second end, a rib extending from the friction buckler through the aperture, and at least portions of the friction buckler being drafted from the first end to the second end. The friction buckler has varying stiffness along the aperture. The rib has a first stiffness at the first end changing to a second stiffness at the second end. The housing is clasped to the media dam. The rib extends above an upper surface of the housing and flexes upon engagement by media.

A media buckler comprises a first surface, opposed sidewalls connected to the first surface, a rib extending across the first surface in a first dimension, at least one of the first surface and the opposed sidewalls drafted along the first dimension to provide the media buckler with varying stiffness along the first dimension. The first surface is drafted in vertical thickness. At least one of the opposed sidewalls is drafted in a vertical thickness. At least one of the opposed sidewall is drafted in a horizontal thickness. The rib has an upper serrated surface. The sidewalls may be substantially L-shaped or substantially S-shaped. The media buckler further comprises a housing disposed over the media buckler. The media buckler further comprises an aperture in the housing, the rib extending through the aperture. The media buckler has a variable stiffness from a first end to a second end of the aperture.

A media buckler comprises a media engagement surface, a support structure having at least one dimension drafted from a first thickness to a second thickness, the engagement surface having varying stiffness.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
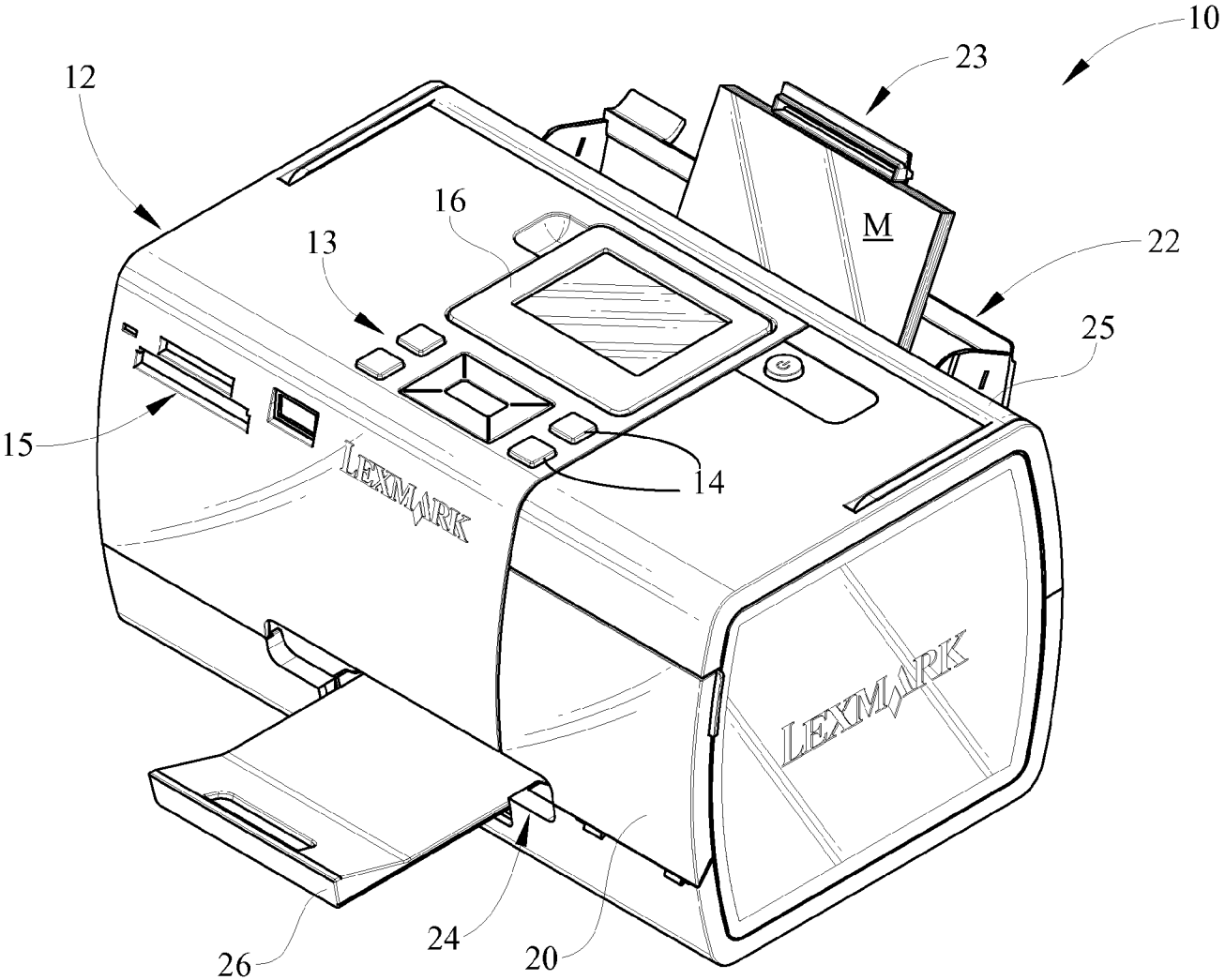
FIG. 1 is a perspective view of an exemplary print peripheral utilizing a media feeding mechanism.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring now in detail to the drawings, wherein like numerals indicate like elements throughout the several views, there are shown in FIGS. 1-15 various aspects of a variable stiffness friction buckler 60. The variable stiffness friction buckler 60 compensates for the varying stiffness of a media stack during feeding in order to achieve one-by-one conveyance of sheets and prevent multi-sheet misfeeds and motor stalls. The variable stiffness friction buckler 60 will be described in the context of a printer. Nevertheless, it should be understood that it is equally applicable to other machines which utilize media sheet feeding mechanisms such as copiers, fax machines, auto-document feeding scanner devices or other mechanisms utilizing such sheet feeding devices for feeding both light and heavy weight media.

Referring initially to FIG. 1, a printing peripheral or device 10 is shown having a housing 12. The exemplary printer 10 is shown and described herein as a photo printer, however one of ordinary skill in the art will understand upon reading of the instant specification that the variable stiffness friction buckler may be utilized with a stand alone printer, copier, auto-document feeding scanner, all-in-one, multi-function peripheral or other peripheral utilizing a sheet feeder. The peripheral device 10 further comprises a control panel 13 on the housing 12 having a plurality of buttons 14 for making selections. The control panel 13 may include a graphics display 16 to provide a user with menus, choices or errors occurring with the system. The exemplary graphics display 16 may also be utilized to view images, which will be printed, and edit the images prior to printing. The exemplary graphics display 16 may be a liquid crystal display (LCD) having an exemplary resolution of about 480×240 pixels but it is within the scope of the present invention that an alternative display type or resolution be utilized. The graphics display 16 may be rotatable from the horizontal position depicted to an upright position for easier viewing during use. The housing 12 may also comprise at least one aperture 15 for receiving memory devices (not shown).

Still referring to FIG. 1, extending from the housing 12 is a media input 22 at the rear of the device 10 and a media output 24 at the front of the device 10 for retaining media M before and after a print process, respectively. Hereinafter, the indicator M is used for both individual sheets (medium) and a plurality of sheets (media). The media input 22 is defined by a tray and may include an extendable media support 23 to support media M while such media M is located in a generally upright position. The media output 24 comprises an aperture in housing 12 along a front surface of the device 10. The media output 24 may also include a tray 26 which is extendable into and out of the output 24 to support media M exiting the peripheral 10. Adjacent the media output 24 is a door 20 providing access to the interior of the peripheral 10 for changing ink cartridges. Along the top surface of housing 12 is a handle 25 to aid in carrying the peripheral 10 although such structure should not be construed as limiting. The handle 25 is pivotably connected to the peripheral 10, however alternative handle constructions may be utilized such as slidably extendable handles or the like.

Figure 2:
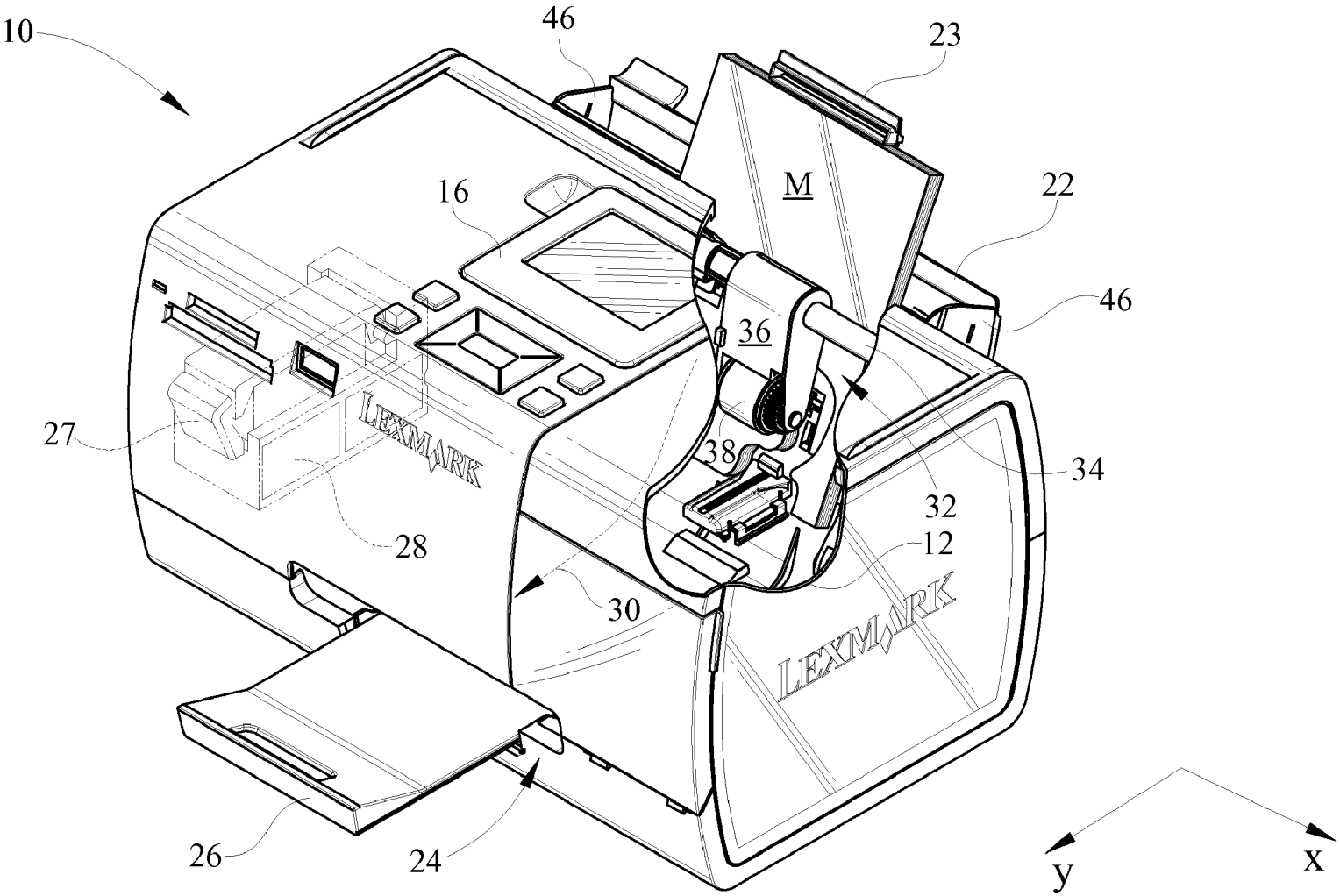
FIG. 2 is a cut-away perspective view of the interior of the peripheral device of FIG. 1 feed area and the input tray.

Referring now to FIG. 2, an interior cut-away perspective view of the printer device 10 is depicted. A media feedpath 30 extends between the input 22 and output 24. The media feedpath 30 is substantially L-shaped in the exemplary embodiment, but one skilled in the art will ascertain that the present invention may alternatively be used with a C-shaped or straight-through media feedpath. Also shown inside the peripheral 10 is a carriage 28 and at least one ink cartridge 27, each depicted in broken lines. The at least one print cartridge 27 which may be, for instance, a color cartridge including three inks for color images i.e., cyan, magenta and yellow. Alternatively, multiple cartridges may be utilized including, for example, a color cartridge and a black ink cartridge for text printing or for photo printing or, in another arrangement, two color cartridges may be used where the second cartridge contains dilute cyan, magenta and yellow inks. During feeding, media M moves from the media input 22 to the media output 24 along the media feedpath 30 beneath the carriage 28 and cartridge 27. As the media moves in a first Y-direction into a printing zone, the carriage 28 and the cartridges 27 move bi-directionally along the second, X-direction through the printing zone and transverse to the movement of the media M. During each scan of the carriage 28 and the at least one cartridge 27, the print medium is held stationary. A driving signal from a print controller to a motor (not shown) causes reciprocating or scanning movement of carriage 28 based on received image data at the printer controller (not shown). A typical ink jet printer forms an image on a print medium by ejecting ink from the plurality of ink jetting nozzles to form a pattern on ink dots on the print medium. The printhead of the cartridge 27 may include a plurality of nozzle arrays, arranged in a column of nozzle arrays. The cartridge 27 is supplied with electric energy to generate a bubble ejecting ink to the adjacent media M.

Shown in the housing cut-away, a media feed mechanism 32 is depicted adjacent the media input 22. Beneath the housing 12 is an auto-compensating mechanism shaft 34. The shaft 34 is rotatably mounted and driven by a gear transmission (not shown) within the peripheral 10. The shaft 34 drives an auto-compensating mechanism (ACM) or rotatable indexing mechanism 36, which picks the uppermost media sheet M within the tray 22 and indexes the media M into the media feedpath 30. The term uppermost should be understood to mean the medium closest to the ACM 36. The indexing mechanism 36 incrementally advances the print medium in a feed (Y) direction. The ACM 36 has a plurality of gears (not shown) and at least one roller 38 which engages each medium M for indexing. The rotatable indexing mechanism 36 is used broadly herein to mean any belt or gear driven sheet pick/feed mechanism or other suitable sheet media advancing means such as the aforementioned ACM 36. Since ACMs 36 are known to one skilled in the art, such structure will not be described further.

Behind the rotatable indexing mechanism 36, the media M is inserted at the media input 22 and against the extendable tray 23 and a planer surface defining a portion of media input tray 22. Extending from the side edges of the input 22 to the housing 12 are media input sidewalls 46 which generally define the maximum media width that can be used in the edge-to-edge printing device 10. Adjacent the at least one sidewall 46 may be at least one automatic edge aligning device slidably positioned for adjustment from an innermost position for narrow media to an outer position for receiving wider media within the input area 22. Further, such edge aligning device may be biased, for instance spring biased, toward the opposite sidewall 46 so that the edges of the media M are aligned on one side by the sidewall 46 and the slidable edge aligning device 47 on the opposite side.

Figure 3:
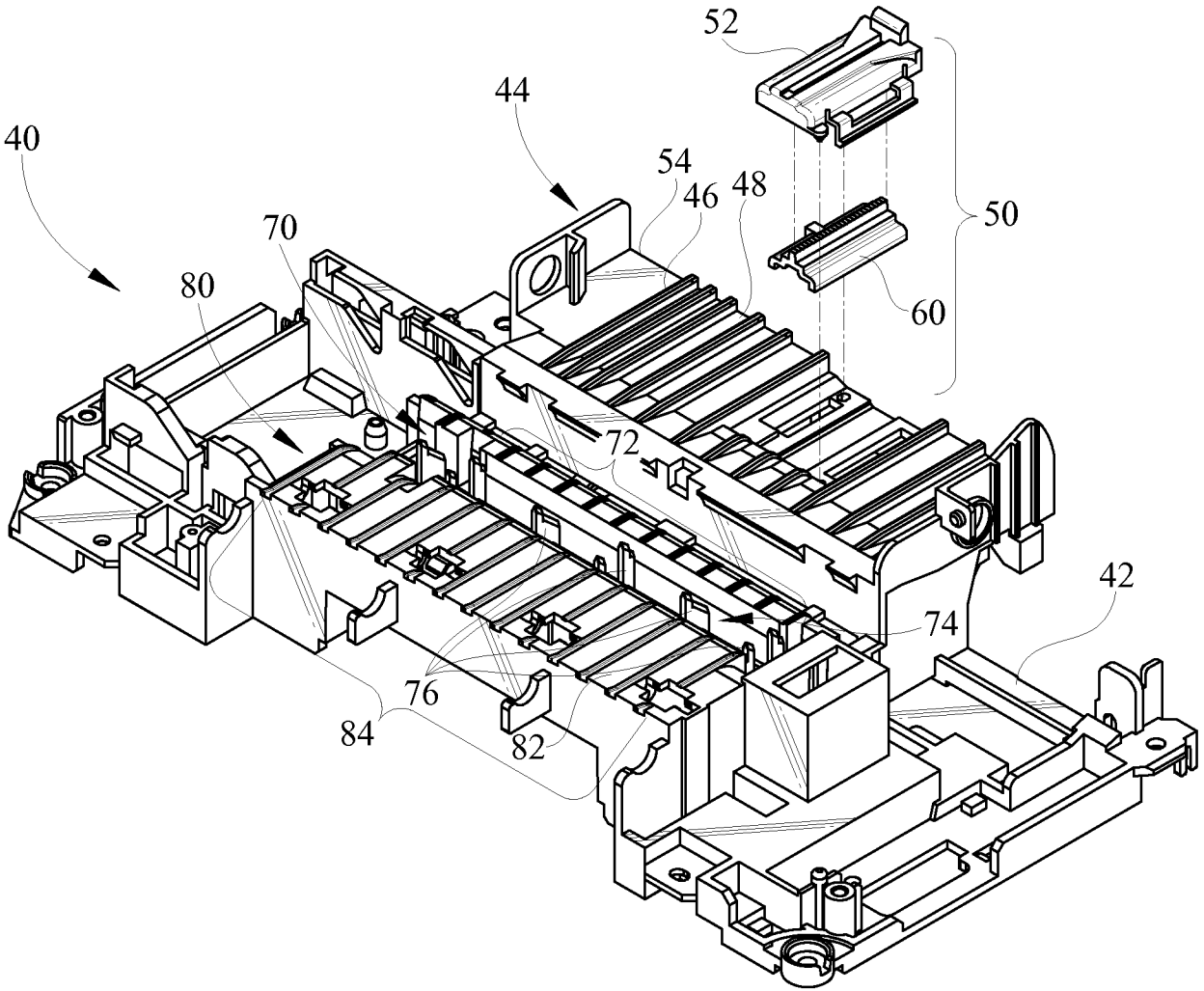
FIG. 3 is a partially exploded perspective view of printer midframe including a variable stiffness friction buckler.

Referring to FIG. 3, a mid-frame 40 is depicted. The mid-frame 40 comprises a lower base surface 42 from which a plurality of molded parts extend. The media input 22 is positioned along a rear portion of the mid-frame base 42 extending upwardly at an angle therefrom so that a media dam 44 defines a lower portion of the media input 22. The media dam 44 includes a plurality of dam ribs 46 extending in a horizontal direction parallel to the Y-direction or feedpath direction 30, previously described. The media M is generally supported by the ribs 46 when inserted into the media input 22. The ribs 46 extend from a body 54 defining a lower surface of the media dam 44 from which the dam ribs 46 extend upwardly. The dam ribs 46 also extend horizontally, as previously defined, in a direction of the media feedpath 30 from the rear of the media input 22 toward a print zone 70.

The media dam 44 further comprises a buckler assembly 50 which is defined by a housing 52, the body 54 and a variable stiffness friction buckler 60, which will be described further herein. When inserted in the media input 22, the media M also engages the buckler assembly 50. Although a single buckler assembly 50 is depicted, multiple assemblies may be utilized. Moving downstream from the media dam 44 along the direction of the media feedpath 30 is the print zone 70 above which the at least one ink cartridge 27 (FIG. 52) is reciprocally moved bi-directionally along the X-axis by the carriage 28 (FIG. 2). As the media M moves into the print zone 70 in the feedpath direction 30, the cartridge 27 and carriage 28 move transversely to the media M and selectively eject ink onto the media M.

As the medium M indexes from the media dam 44 towards the print zone 70, the leading edge of the medium M engages a plurality of print zone entry ribs 72. The entry ribs 72 support the leading edge of each medium M as it enters the print zone 70 and portions of the medium M upstream of the print zone 70 as indexing continues. Downstream of the entry ribs 72 is an ink trough 74 which collects overspray during edge-to-edge printing. Within the ink trough 74 are a plurality of support ribs 76 which support the medium M as the medium passes over the ink trough 74. Once the leading edge of the medium M passes the ink trough 74, the medium M engages an exit frame 80 having a base 82, a plurality of exit plurality ribs 84, as well as exit rollers (not shown) which are housed within the exit frame 80 and aligned with the exit ribs 84. The medium M, containing the printed image, passes from the exit rollers (not shown) and exits the peripheral 10 through the media output 24.

Figure 4:
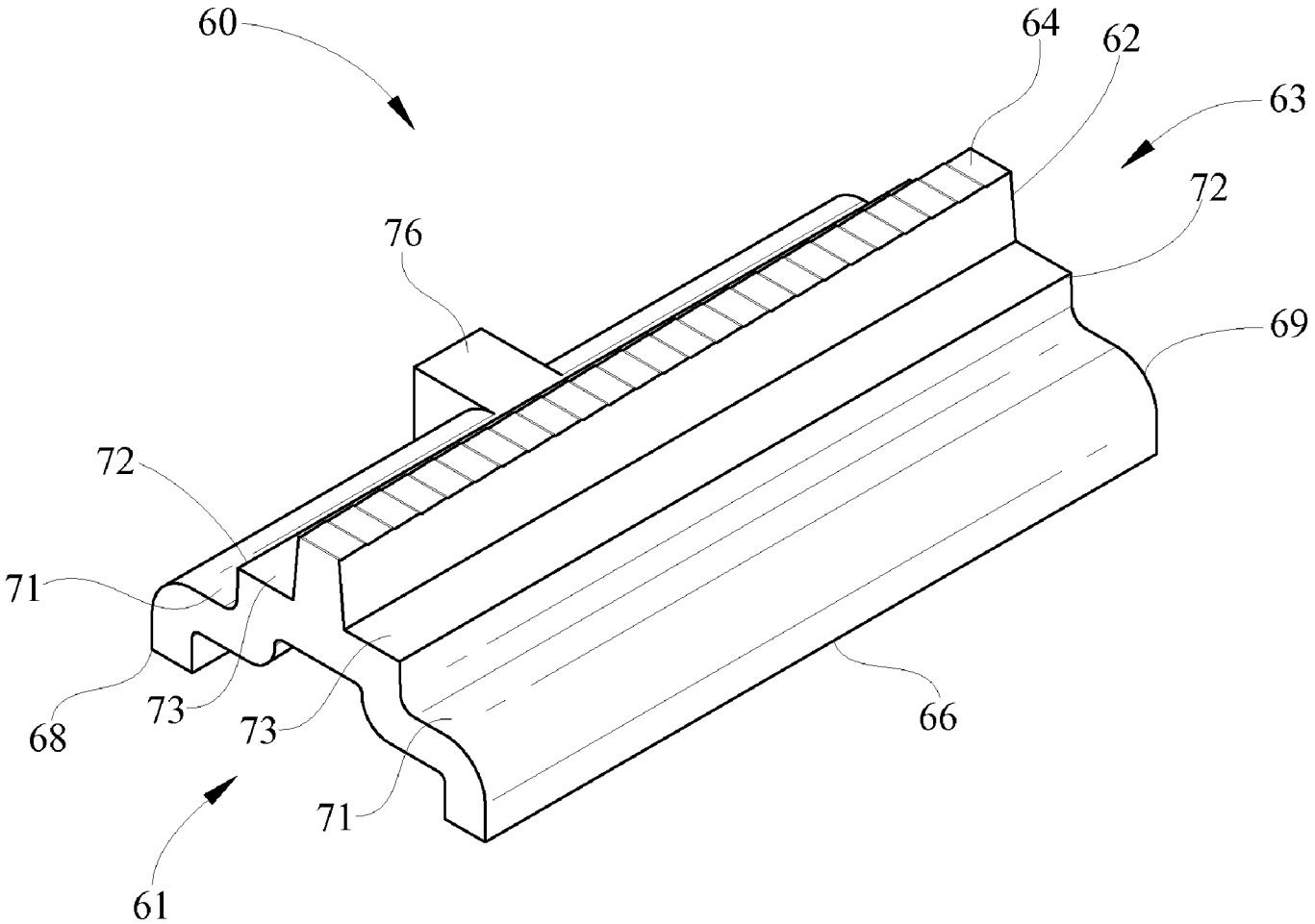
FIG. 4 is a perspective view of the variable stiffness friction buckler.

Referring now to FIG. 4, the variable stiffness friction buckler 60 is depicted in perspective view. The buckler 60 may have a high coefficient of friction with media M and may be formed of polyurethane, for example. One such example of a suitable material is sold by Dow Corporation as Pellethane 2103 70 Shore A. The variable stiffness friction buckler 60 is generally rectangular with a longitudinal axis extending generally parallel to the long dimension of the buckler 60. Perpendicular to the longitudinal axis are first and second ends 61, 63 which have a shorter dimension than parallel sides 66, 68. However, such structural/shape description should not be considered limiting, but instead merely exemplary. The variable stiffness friction buckler 60 comprises an upper rib 62 having a serrated upper edge surface 64. The rib 62 extends from a first surface 73. Depending from the first surface 73 are substantially s-shaped opposed sidewalls generally having three legs. The lower first legs form the edges 66, 68. The first legs and second legs are connected by radiused corner 69 wherein a second surface 71 of the second leg defines a lower step. The second and third legs form a radiused corner leading to a connection with the first surface 73. The connection between the third leg and the first surface 73 forms an edge 72. According to this construction, the buckler 60 is generally stepped along two sides from lower edges 66, 68 up the substantially s-shaped sidewalls toward the first surface or upper step 73. However, the s-shaped sidewall is merely exemplary and should not be construed as limiting as various other shapes could be used, for instance, c-shaped, L-shaped, z-shaped or other structural shapes. Extending from one side of the buckler 60 and transverse to the longitudinal length of the rib 62 is a finger 76. The finger or key 76 locates the buckler 60 relative to the housing 52 and body 54 so that the buckler 60 is properly retained between the body 54 and housing 52 and so that the stiffer end 61 of the buckler is properly oriented, as related to stiffness, relative to the media M in the media input 22.

Figure 5:
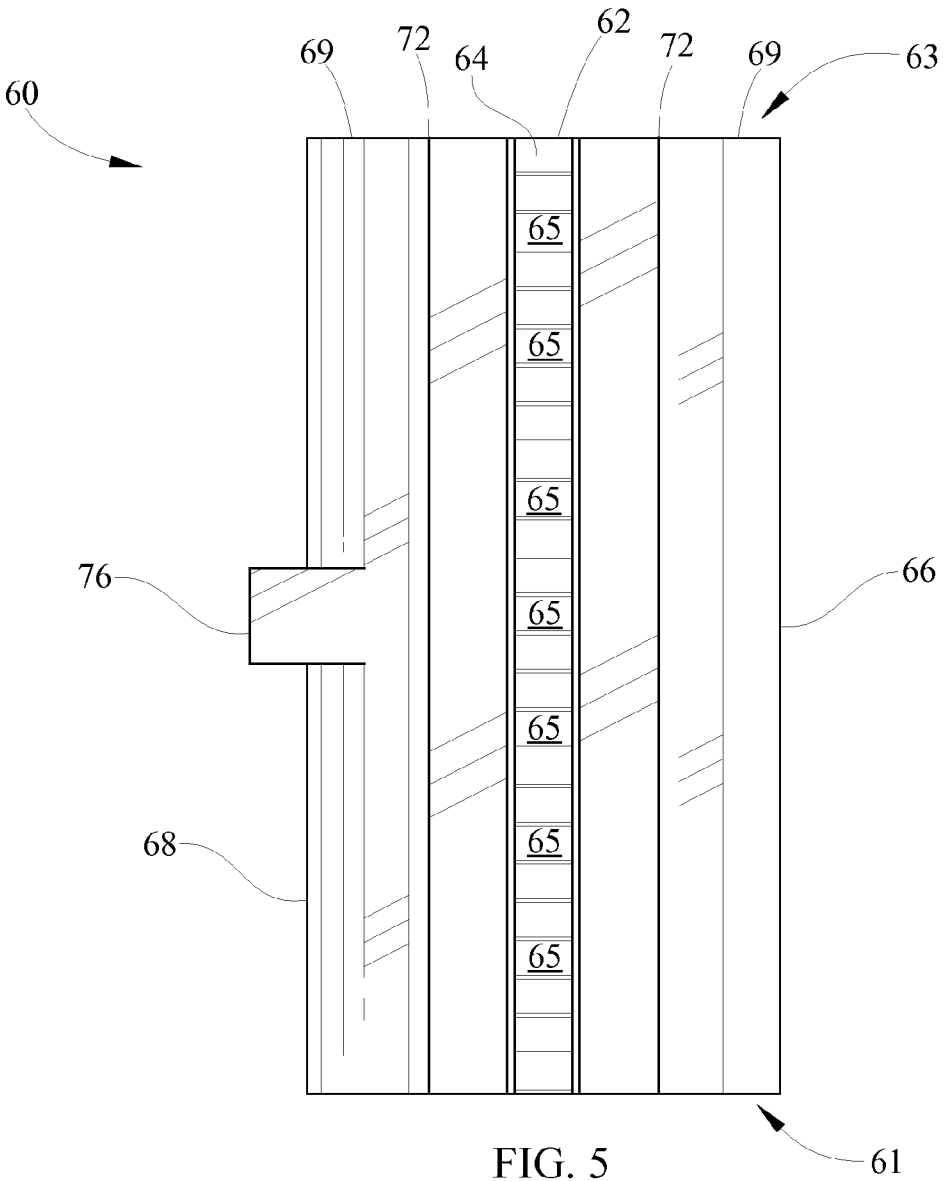
FIG. 5 is a top view of the variable stiffness friction buckler of FIG. 4.
Figure 6:
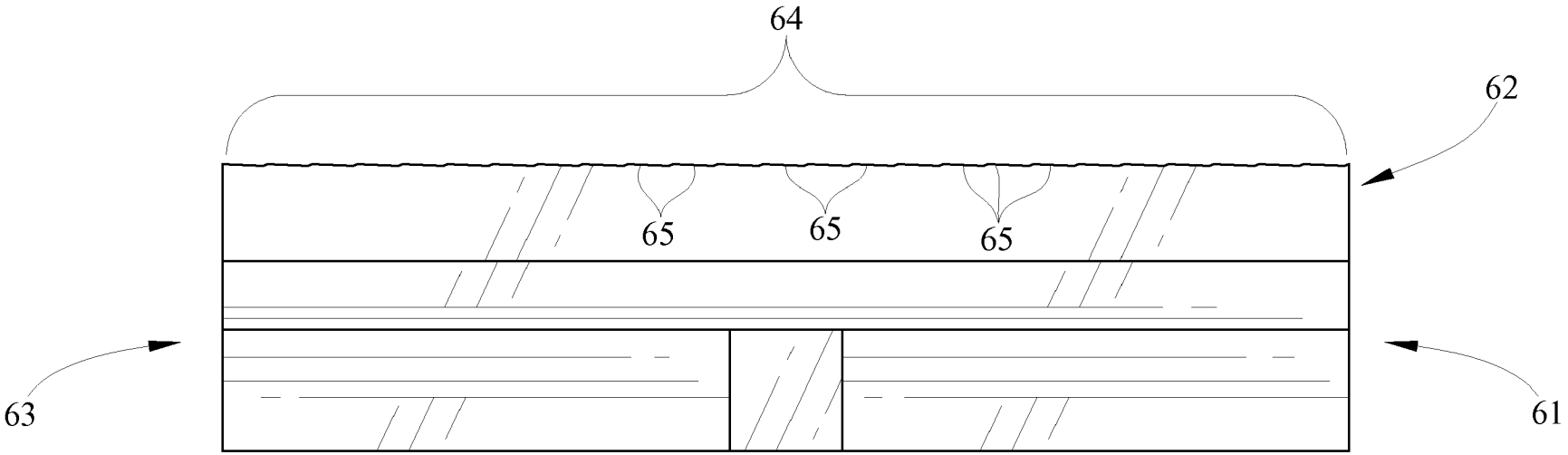
FIG. 6 is side view of the variable stiffness friction buckler of FIG. 4.

Referring to FIG. 5, a top view of the variable stiffness friction buckler 60 is depicted. The exemplary buckler 60 is generally rectangular in shape although alternative shapes may be utilized. The sides 66, 68 and ends 61, 63 generally define the shape of the buckler 60 but are merely illustrative. The rib 62 extends in a longitudinal direction of the buckler 60 and is generally rectangular in shape, parallel to sides 66, 68. The rib 62 has a length which may correspond to the thickness of the media stack M although the media stack M, in the media input 22, may be thicker than the length of the rib 62. As shown in the side view of FIG. 6, the upper serrated edge surface 64 has a plurality of teeth 65 which grab the edge of each medium as the media stack M is indexed into the media feedpath 30.

Figure 7:
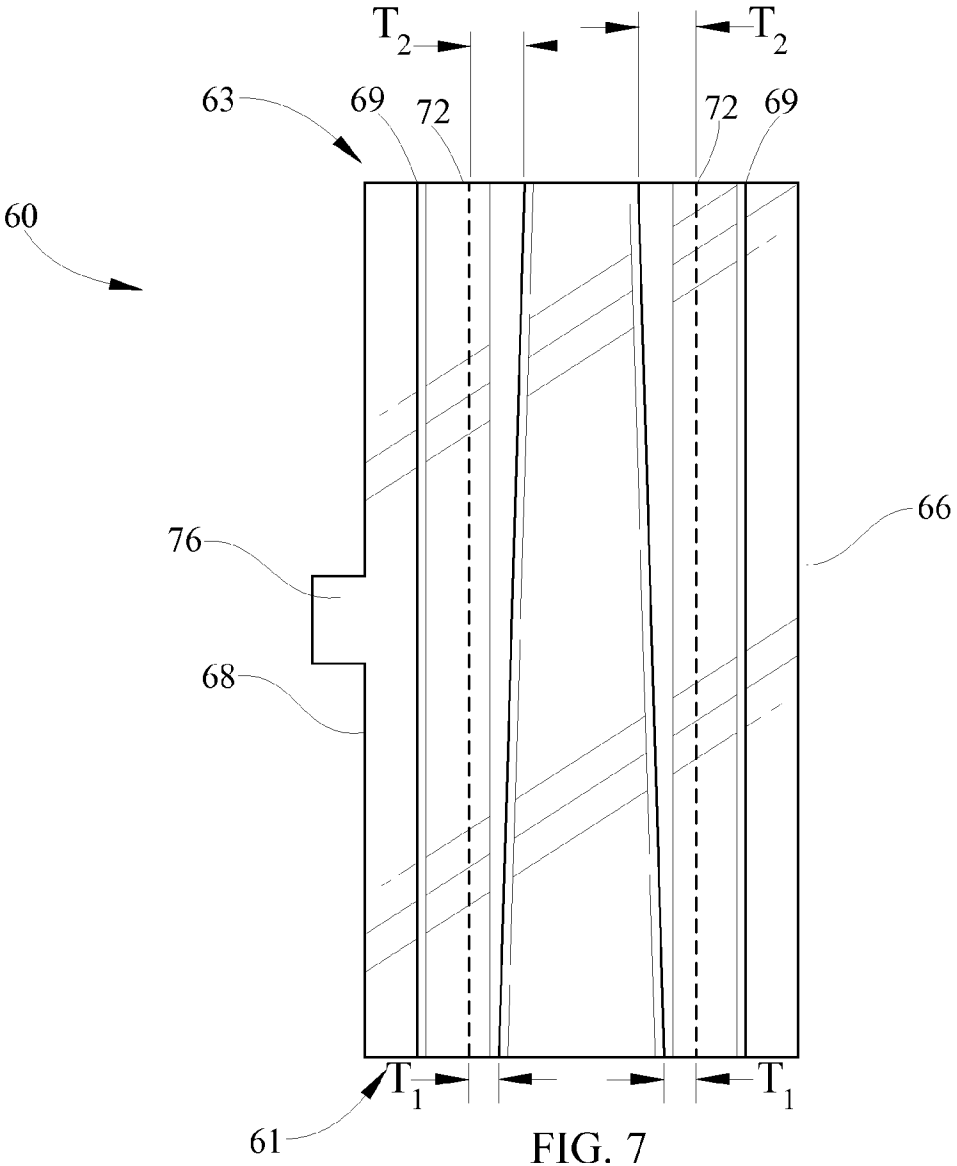
FIG. 7 is a bottom view variable stiffness friction buckler of FIG. 4.

Referring now to FIG. 7, a bottom view of the variable stiffness friction buckler 60 is depicted. The buckler 60 comprises first and second longitudinal edges 66, 68 as well as the finger or key 76 previously described in order to locate and orient the buckler between the housing 52 and base 54. The lower radiused surface 69 and the upper edge 72 are depicted extending along the longitudinal dimension of the buckler 60 between first and second ends 61, 63. For purpose of reference, during operation, the media M is fed from the second end 63 toward the first end 61 so as to engage teeth 65 during feeding. Adjacent to the upper edges 72 are lines which also extend on an angle from one end of the buckler 60 to the opposite end generally in the longitudinal direction of the buckler 60. At one end of the buckler, the thickness between the lines is measured as $T_1$. At the opposite end of the buckler, the thickness is measured as $T_2$ wherein $T_1$ is less than $T_2$. This change in thickness along the length of the buckler 60 provides a taper or draft of the material. As a result of the taper, the material of the buckler 60 is thicker at one end than the opposite end. Such design provides the variable stiffness of the friction buckler 60.

Figure 9:
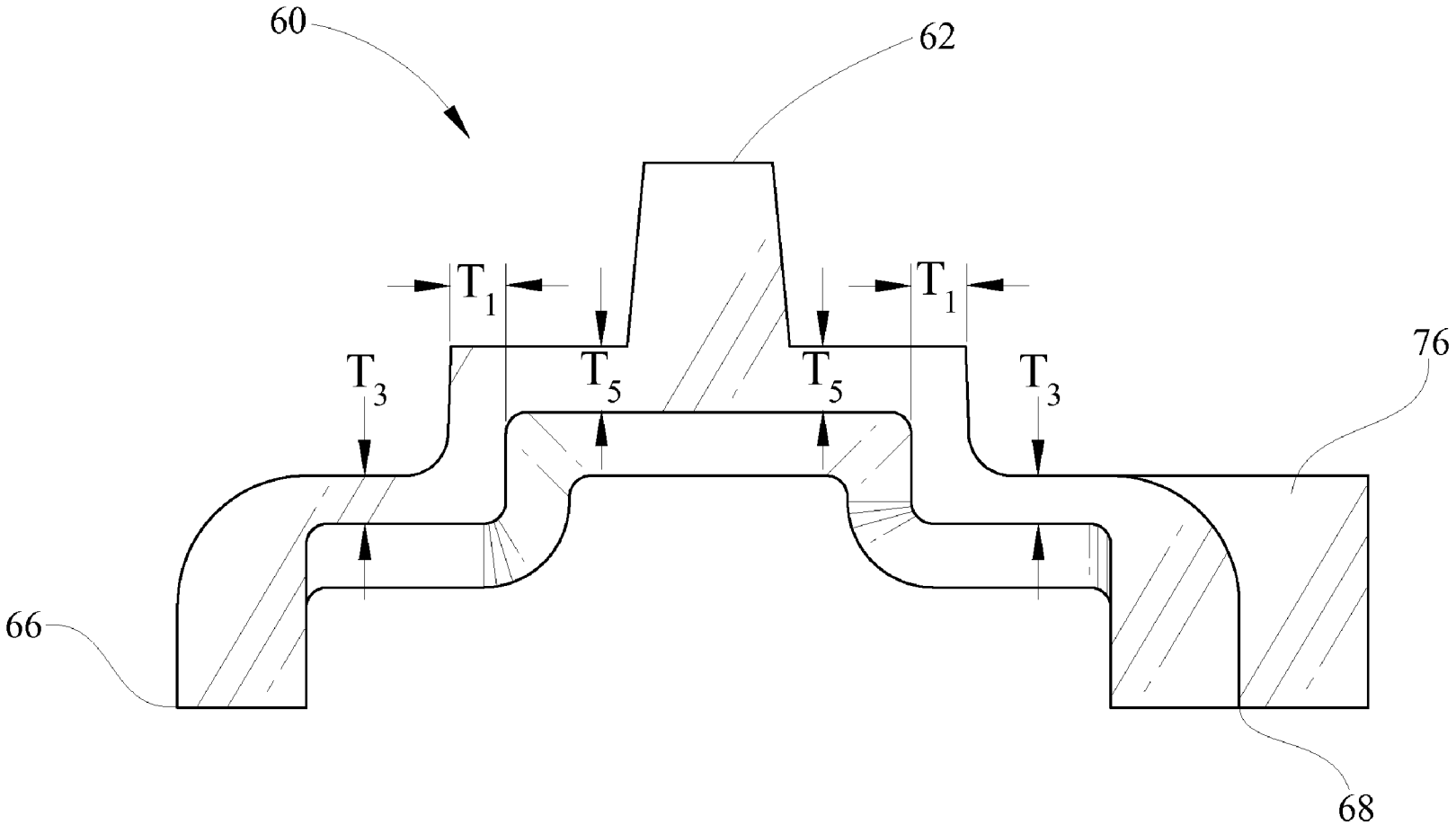
FIG. 9 is an end view of the variable stiffness friction buckler of FIG. 4.
Figure 10:
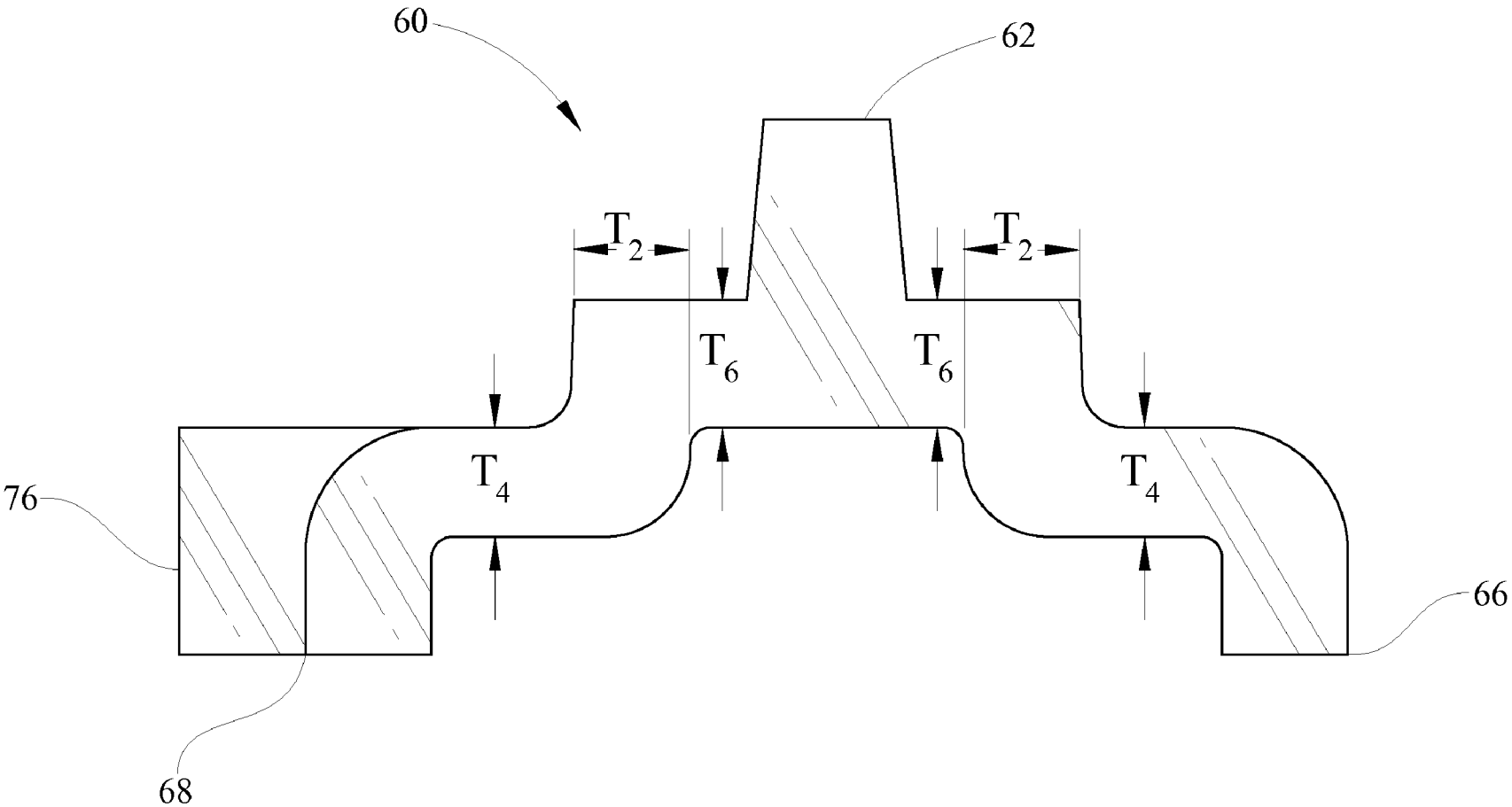
FIG. 10 is an end view opposite the view of FIG. 9.

Referring to FIGS. 9 and 10, the buckler 60 is shown in first and a second end views, respectively. In FIG. 9, the first end 61 of the buckler 60 is depicted with a thickness $T_1$. Beneath the material labeled $T_1$, the taper is shown moving toward the second end of the buckler 60. As shown in the opposite end view of FIG. 10, the thickness $T_2$ of the material is greater than that of $T_1$, shown in FIGS. 7 and 9. As a result, the stiffness of the end of buckler 60 shown in FIG. 10 is greater than the stiffness of the buckler 60 shown in FIG. 9. Likewise, measurements $T_3$ and $T_5$ are less than $T_4$ and $T_6$, respectively. These differences are provided by the draft of buckler material described above.

Figure 12:
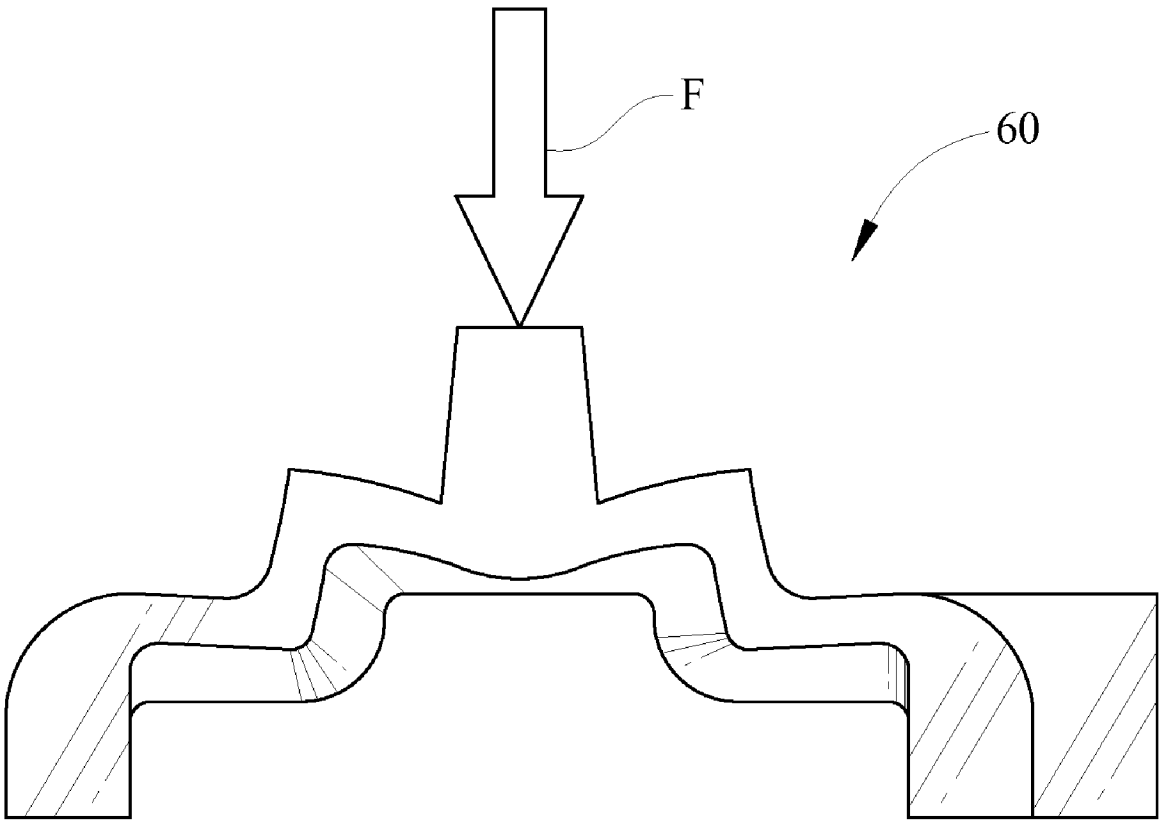
FIG. 12 is an end view of first end the variable stiffness friction buckler deflected due to a force of a given magnitude applied to the buckler.
Figure 13:
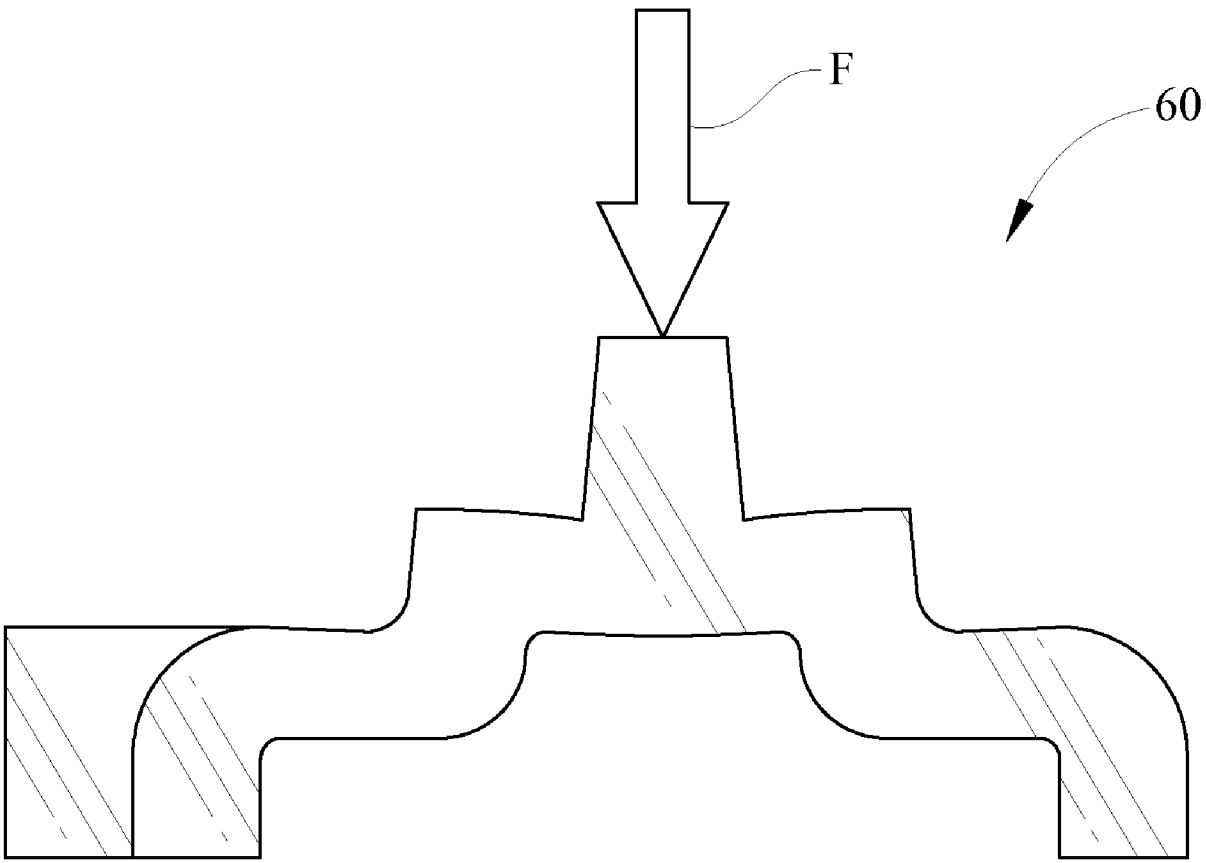
FIG. 13 is an end view of the opposite second end of the variable stiffness friction buckler deflected due to the force shown in FIG. 12 applied to the buckler to illustrate a lower degree of deflection than the first end.

The varying stiffness function of buckler 60 is clearly indicated in FIGS. 12 and 13. The figures depict each end of the buckler 60 with a down force F of a given magnitude acting on the rib 62 of the buckler 60. The force F depicts the force of the media pressing against the media buckler 60 during media feeding. As shown in FIG. 12, the thin end of the buckler 60 has a greater deflection than that shown in FIG. 13 for the same magnitude of force.

Figure 8A:
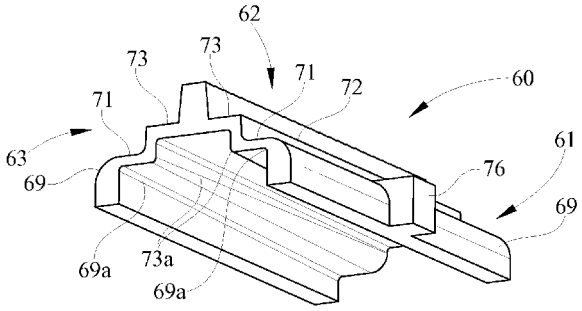
FIGS. 8*a*-8*e* are various views of the variable stiffness friction buckler of FIG. 4.
Figure 8B:
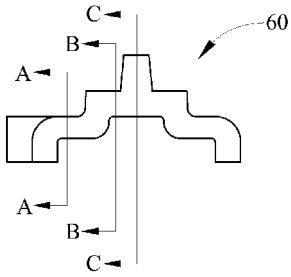
Figure 8C:
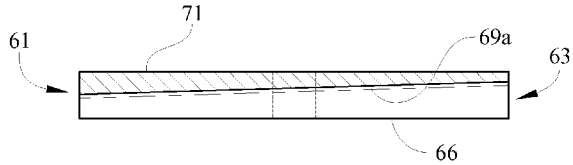
Figure 8D:
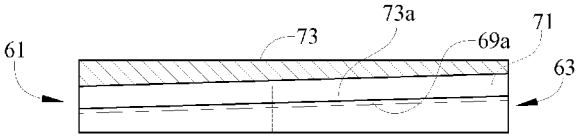
Figure 8E:
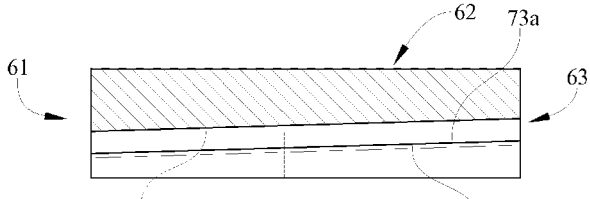

Referring back to FIGS. 8*a*-8*e*, a various views of the variable stiffness friction buckler 60 are depicted. Referring first to FIG. 8*a*, a perspective view of the buckler 60 is shown from the second end 63. The top line of the rib 62 is depicted with the serrated feature, which retains media M while an uppermost medium is picked. Also, the drafted structure of various corners and surfaces of the buckler 60 is also seen from the view of FIG. 8*a*. Referring to FIG. 8*b*, a side view of buckler 60 is depicted with section lines A-A, B-B and C-C corresponding to the view of 8*c*, 8*d*, and 8*e*. Referring first to FIG. 8*c*, the buckler 60 is shown sectioned along line A-A of FIG. 8*b*. The upper line represents surface 71 and an angled line between the lower edge or side 66 and surface 71 represents the drafted corner 69*a* between the first and second legs of the s-shaped sidewall. Referring to FIG. 8*d*, corresponding to Section B-B, the upper line 73 represents first surface 73 from which the s-shaped legs depend. A drafted corner 73*a* is shown between the second and third legs of the s-shaped sidewall. The draft or taper provides the change in thickness from the first end 61 toward the second end 63 of buckler 60. With reference to FIG. 8*e*, the buckler is sectioned through the rib 62. The angled lines 69*a* and 73*a* indicate the change in thickness across the buckler 60. The change in thickness depicted in FIGS. 8*a*-8*e*, across the longitudinal dimension of the buckler 60, is correspondingly shown in FIGS. 9 and 10 as a change in thickness from thickness $T_3$ and $T_5$ to $T_4$ and $T_6$, respectively. The thicknesses $T_3$ and $T_5$ may or may not be equivalent thicknesses. Likewise, thicknesses $T_4$ and $T_6$ may or may not be equivalent thicknesses. In FIG. 9, $T_3$ is represented at the thin end 63 of the buckler 60. In FIG. 10, $T_4$ is represented at the thick end 61 of the buckler 60. Likewise, the thin end 63 of the buckler 60 has a stiffness less than the thick end 61 of the buckler 60. In combination, FIGS. 8-10 depict the structure providing the variable stiffness function.

Figure 11:
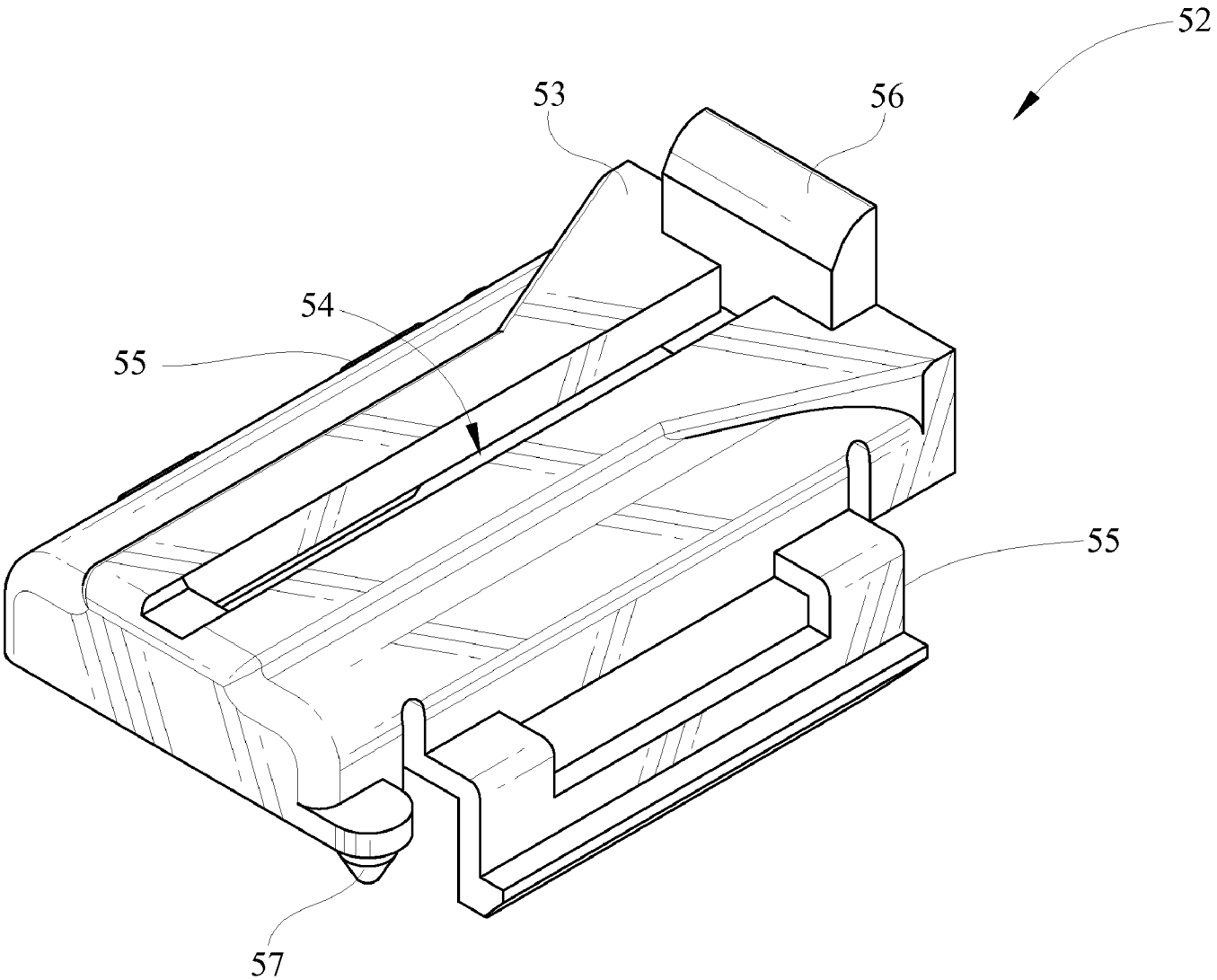
FIG. 11 is a perspective view of a friction buckler housing.

Referring now to FIG. 11, the housing 52 is depicted in perspective view. The housing comprises a hollow body portion 53 having at least one retaining arm 55 extending from the body 53. The depicted housing 52 comprises opposed retaining arms extending from longitudinal sides of the body 53. The housing 52 is generally rectangular in shape having parallel longer longitudinal dimensions and parallel shorter latitudinal dimensions. The body 53 also has a media lip 56 extending from an upper surface thereof. The media lip 56 has a rounded or tapered upper edge so as to direct media downward to the upper surface of the body 53. The media lip 56 therefore directs media toward the top surface of the body 53 by inhibiting media from being retained in a position above the upper surface of body 53. The housing 52 further comprises a slot 54 which extends longitudinally along the central portion of the body 53. The slot 54 has a length and width which generally match that of the rib 62 of the buckler 60. Since the body 53 is generally hollow, the housing 52 is positioned over the buckler 60 and the rib 62 extends through the slot 54. The rib 62 may extend above the uppermost surface of the hollow body so that as media M is positioned in the media input 22, the media M engages the seriated upper surface 64 of the rib 62. The housing 52 is formed of a material having a lower coefficient of friction than the buckler rib 62. As shown in FIG. 2 and with respect to FIG. 11, the buckler 60 is oriented so that the thin, less stiff end of the buckler 60 is positioned toward the media lip 56. As the media stack M, gets smaller and the stiffness of the stack M increases, the media M is engaging the less stiff end of the buckler 60. The housing 52 may also comprise one or more aligning pins 57 for proper alignment of the housing 52 relative to the body 54 of media dam 44.

Figure 14:
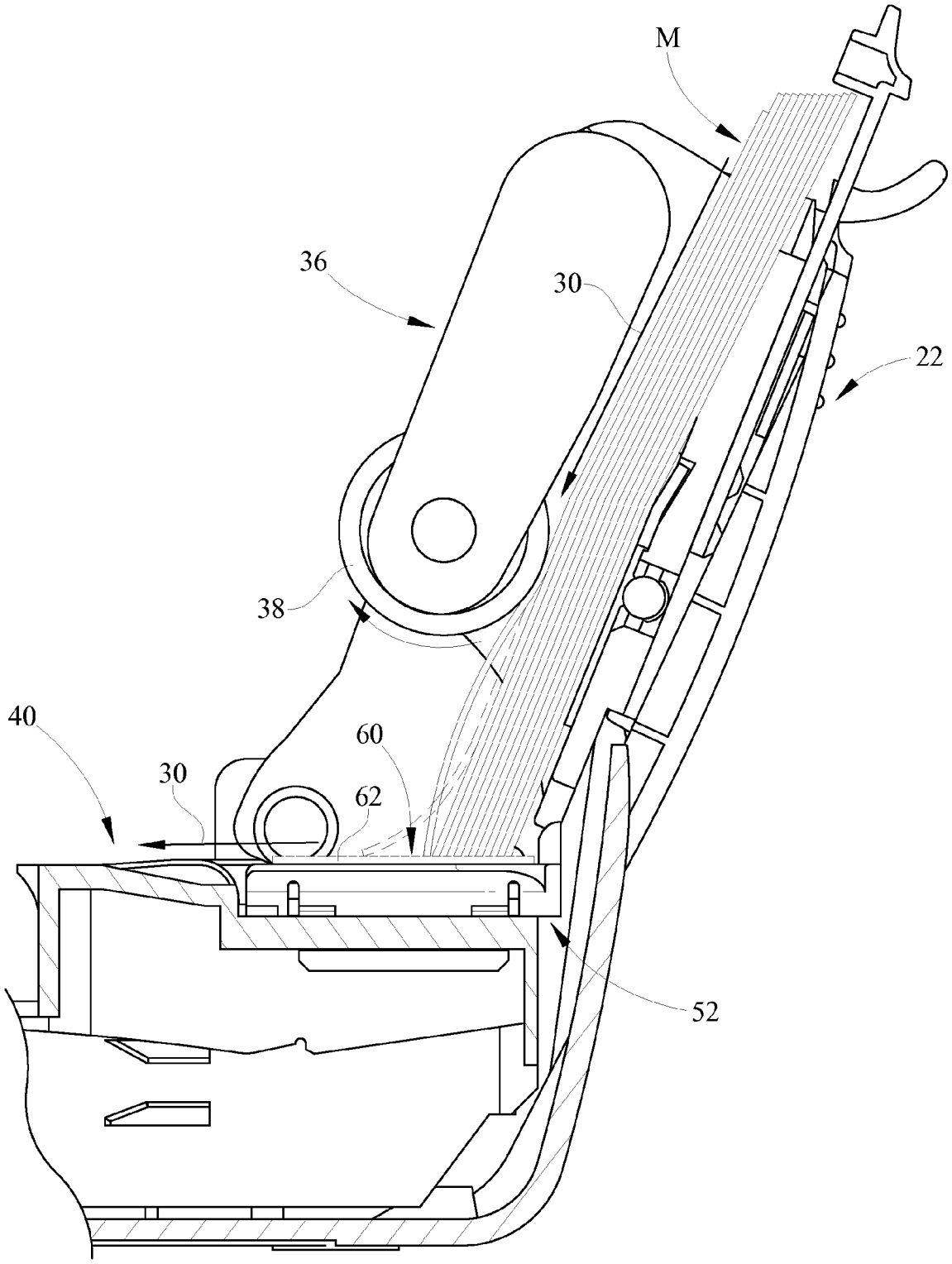
FIG. 14 is a side view of the media feedpath depicting the friction buckler assembly in position with a larger stack of media; and, FIG. 15 is a side view of the media feedpath depicting the friction buckler assembly in position with a smaller stack of media.
Figure 15:
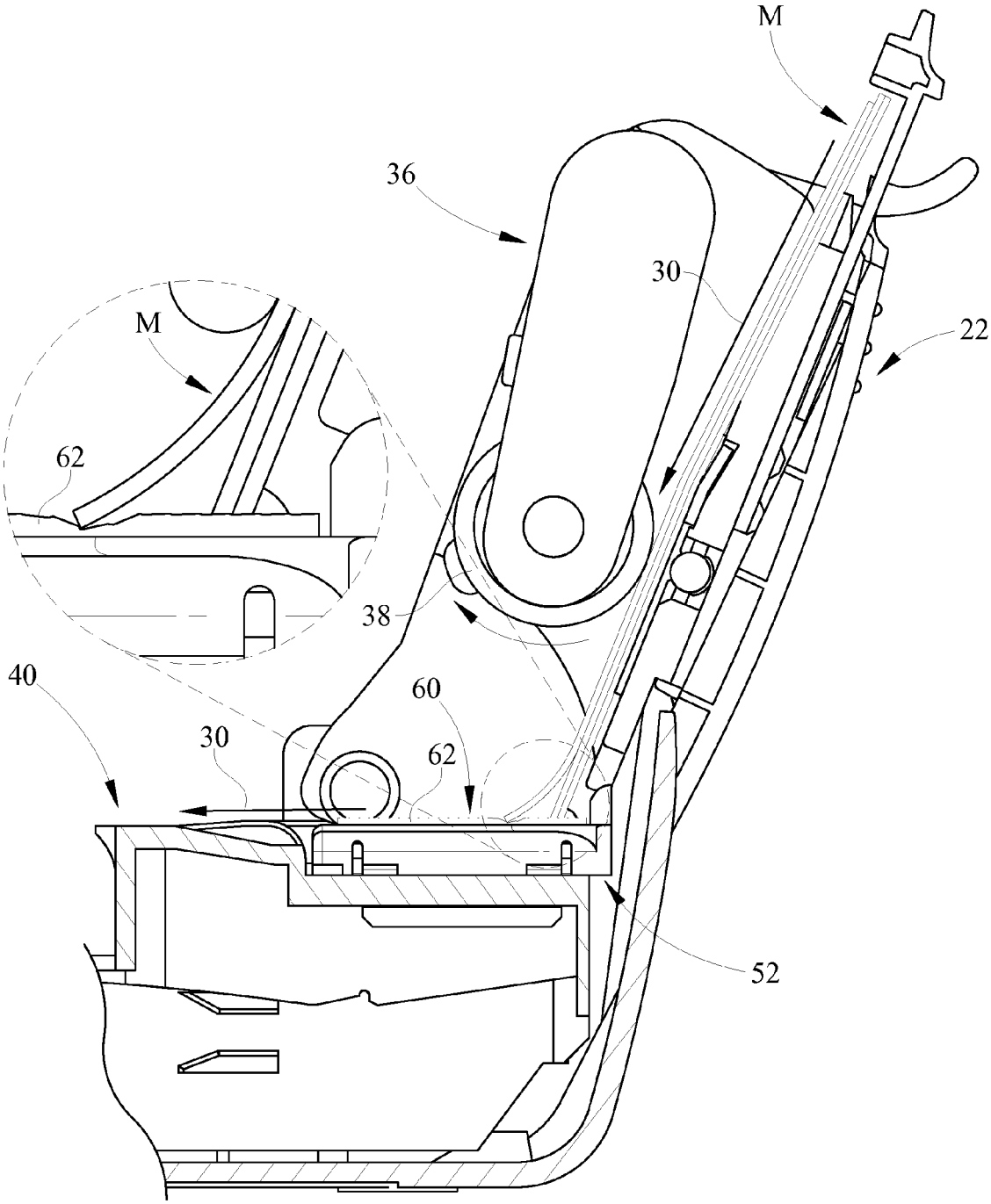

Referring now to FIGS. 14 and 15, in operation the media M is inserted into the media input 22 and extends downwardly into the peripheral 10 until the leading edge of the media engages the ribs 46 of the media dam 44 (FIG. 3). For purpose of simplifying this description, the media M may be a thin, lightweight media or may be a thicker heavyweight media, each of which may vary in weight and thickness as will be understood by one skilled in the art. In the case of thin, lightweight media, the media leading edge engages the buckler assembly 50, specifically, the upper surface 64 of the buckler 60. With a full stack of media M in the media input 22, the media stack M extends across the length of the buckler 60 and the surface 64 (FIG. 4). Sheets in a stack inherently have a frictional sticking force causing them to stick together so as not to separate. Thus, to separate the top or uppermost sheet from the stack, the sticking force must be overcome.

The indexing mechanism 36 engages the media M and rotates such that a normal force causes the light media stack M to push down on the buckler 60. Since the lightweight media stack M is full with a larger thickness and decreased stiffness. Due to the stack thickness, the uppermost medium M is engaging the downstream end 61 of buckler 60 which has a greater stiffness than the opposite end 63. When media M having a low stiffness feeds and engages the high coefficient of friction buckler 60, the low stiffness media may not force the buckler downwardly through the slot 54. The leading edge of the uppermost sheet M begins to bend or fold under itself. In this condition the media M is said to corrugate or buckle, as shown in FIG. 14. Next the media M pops up or outwardly away from the media stack M, as shown in broken line in FIG. 14, allowing the uppermost sheet M to slip relative to the next-to-top sheet for feeding.

Alternatively, when the media M has a higher stiffness, media feeding may be more difficult. After the heavyweight media is positioned in the media input 22, the indexing mechanism 36 engages the media M and a normal force causes the media stack M to move downward into the buckler 60 so that the buckler surface 64 flexes downwardly within the aperture 54. With the media stack M full and having a larger thickness, the uppermost medium M is engaging the downstream end 61 of buckler 60, which has a greater stiffness than the opposite end 63. The normal force on the media stack M pushes down on the buckler 60 so that the uppermost media M may begin to buckle, as previously described, and slip allowing feeding. Alternatively, if the media M is stiff enough, and depending on the media characteristics such as weight and thickness, the indexing mechanism 36 may push the entire media stack into the buckler 60. As a result, uppermost media sheet may not buckle but instead may begin to slip relative to the second sheet due to the flexing characteristic of the buckler 60. This allows feeding of the uppermost sheet while the next to uppermost sheet is held in place against the buckler surface 64. In either event, the low coefficient upper surface of the housing 52 allows the medium M to advance along the media feedpath 30.

With either the lightweight media or heavyweight media M, as feeding continues the media stack M decreases in thickness and stack stiffness increases. This smaller stack is shown in FIG. 15. As this happens, the media M engages the opposite end 63 of the buckler 60 which has a decreased stiffness relative to the first end 61. As previously described, a thinner stack of media M becomes stiffer and more difficult to overcome the friction between the uppermost sheet and next to uppermost sheet due to the increased normal force by the rotational indexing mechanism 36. When the media M is stiffer, the indexing mechanism 36 tries to feed the entire stack M rather than a single sheet due to the increased normal forces. To compensate for this, the second end 63 of buckler 60 is less stiff allowing more give than the first end 61 and allowing the uppermost medium M to slip relative to the second sheet. Further, the low coefficient of friction surface of the housing 52 allows the medium M to continue feeding into the media path 32. Thus, the media M may be heavyweight or lightweight and may be a thick or thin media stack M. In any combination, the buckler 60 allows for feeding of media M.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A media buckler, comprising:

a first surface;

opposed sidewalls connected to said first surface; and a rib extending across said first surface in a first dimension wherein at least one of said first surface and said opposed sidewalls drafted along said first dimension to provide said media buckler with varying thickness along said first dimension.

2. The media buckler of claim 1 wherein said first surface is drafted in vertical thickness.

3. The media buckler of claim 1 wherein at least one of said opposed sidewalls is drafted in a vertical thickness.

4. The media buckler of claim 1 wherein at least one of said opposed sidewall is drafted in a horizontal thickness.

5. The media buckler of claim 1 wherein said rib comprises an upper serrated surface.

6. The media buckler of claim 1 wherein said sidewalls are substantially L-shaped.

7. The media buckler of claim 1 wherein said sidewalls are substantially s-shaped.

8. The media buckler of claim 1 further comprising a housing disposed over said media buckler.

9. The media buckler of claim 8 further comprising an aperture in said housing, said rib extending through said aperture.

10. The media buckler of claim 9 wherein said media buckler has a variable stiffness from a first end to a second end of said aperture.

11. A media buckler, comprising:

a first surface defining a first dimension from a first end to a second end;

a first s-shaped sidewall depending from said first surface;

a second s-shaped sidewall depending from said first surface; and a rib extending from said first surface;

wherein at least one of said first surface, said first s-shaped sidewall and said second s-shaped sidewall is drafted from a first thickness to a second thickness along said first dimension.

12. A media buckler, comprising:

a first surface defining a first dimension from a first end to a second end;

a first s-shaped sidewall depending from said first surface;

a second s-shaped sidewall depending from said first surface; and a rib extending from said first surface;

wherein each of said first surface, said first s-shaped sidewall and said second s-shaped sidewall is drafted from a first thickness to a second thickness along said first dimension.

13. A media buckler, comprising:

a first surface defining a first dimension from a first end to a second end;

a first s-shaped sidewall depending from said first surface;

a second s-shaped sidewall depending from said first surface; and a rib extending from said first surface;

wherein said media buckler has variable thickness along said first dimension and at least portions of said first s-shaped sidewall and said second s-shaped sidewall are continuously tapered from said first end to said second end.

14. The media buckler of claim 12 wherein only portions of said s-shaped sidewalls are drafted.

15. The media buckler of claim 11 further comprising a rectangular housing including a hollow body portion for receiving the media buckler therein, the housing having at least one retaining arm extending from the body for engagement with a mounting surface, the housing having a slot in a top surface extending longitudinally along the length of the housing through which the rib of the media buckler extends.

16. The media buckler of claim 12 further comprising a rectangular housing including a hollow body portion for receiving the media buckler therein, the housing having at least one retaining arm extending from the body for engagement with a mounting surface, the housing having a slot in a top surface extending longitudinally along the length of the housing through which the rib of the media buckler extends.

17. The media buckler of claim 13 further comprising a rectangular housing including a hollow body portion for receiving the media buckler therein, the housing having at least one retaining arm extending from the body for engagement with a mounting surface, the housing having a slot in a top surface extending longitudinally along the length of the housing through which the rib of the media buckler extends.

* * * * *